United States Patent [19]

Mulcahy

[11] 4,363,278

[45] Dec. 14, 1982

[54] RESILIENT RAILWAY TRUCK BEARING ADAPTOR

[75] Inventor: Harry W. Mulcahy, Griffith, Ind.

[73] Assignee: AMSTED Industries Incorporated, Chicago, Ill.

[21] Appl. No.: 186,218

[22] Filed: Sep. 11, 1980

[51] Int. Cl.[3] ..... B61F 5/30; B61F 5/52; B61F 15/02

[52] U.S. Cl. ..... 105/218 R; 105/224.1

[58] Field of Search ..... 105/218 R, 224.1, 225

[56] References Cited

U.S. PATENT DOCUMENTS

| | | | |
|---|---|---|---|
| 3,211,112 | 10/1965 | Backer | 105/224.1 X |
| 3,381,629 | 5/1968 | Jones | 105/218 R |
| 3,638,582 | 2/1972 | Beebe | 105/224.1 X |
| 3,699,897 | 10/1972 | Sherrick | 105/224.1 X |
| 3,897,736 | 8/1975 | Tack | 105/225 |

*Primary Examiner*—Robert B. Reeves
*Assistant Examiner*—Howard Beltran
*Attorney, Agent, or Firm*—Edward J. Brosius; Fred P. Kostka; Tony T. Shu

[57] ABSTRACT

In a railroad car truck an elastomeric device is used to operatively connect each axle end of the wheelsets to a respective pedestal jaw of the side frames. The elastomeric device may comprise an elastic pad affixed between two metal plates. By choosing an elastic material having a relative high stiffness in shear, movements between the wheelsets and side frames are cushioned while at the same time the wheelsets and side frames are held in a substantially squared relationship. The squared relationship improves the dynamic stability of the truck by increasing its critical speed to allow higher speed travel.

2 Claims, 4 Drawing Figures

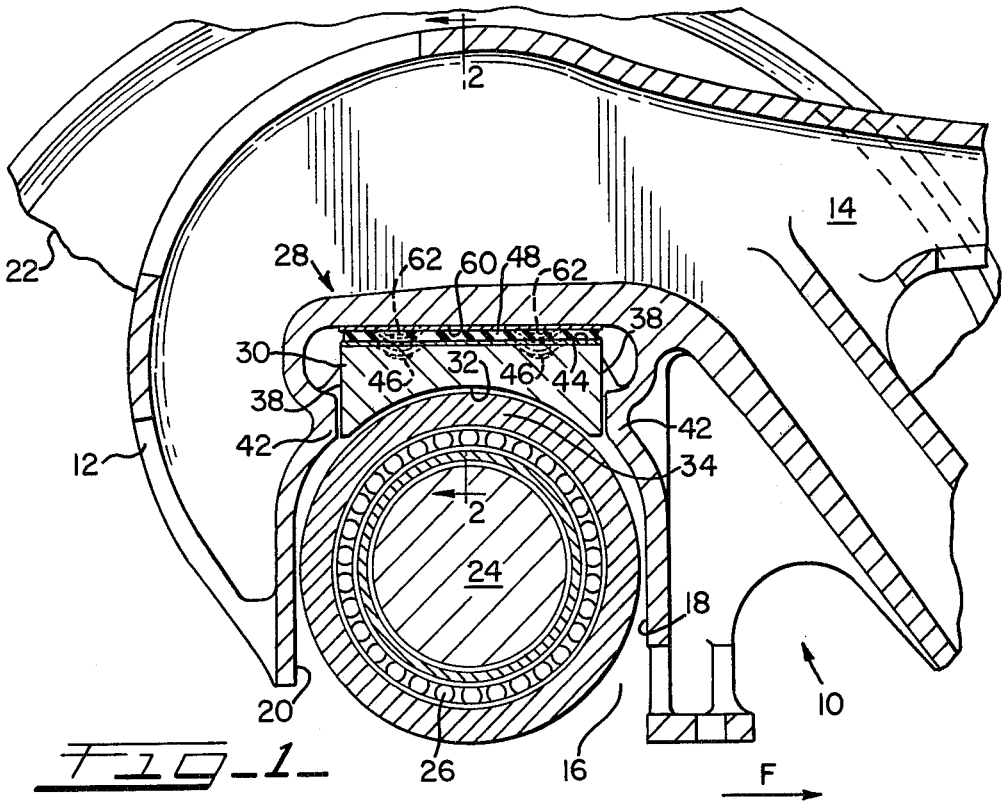
FIG. 1
FIG. 2
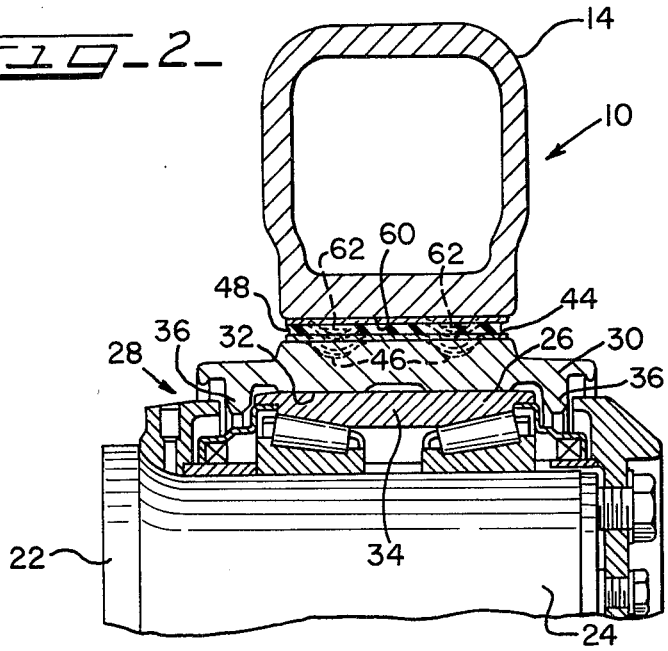

RESILIENT RAILWAY TRUCK BEARING ADAPTOR

BACKGROUND OF THE INVENTION

1. Field of the Invention

This invention relates to railroad car trucks and more particularly to a truck having improved dynamic characteristics by maintaining the wheelsets and side frames of the truck in a squared relationship.

2. Prior Art

Railroad car trucks in common use today are often referred to as a three-piece truck wherein spaced side frames resiliently carry therebetween a transversely positioned bolster. A pair of wheelsets are in turn rotatively carried by the side frames.

Structure joining the wheelsets to the side frames may take a number of forms. For example, U.S. Pat. No. 3,211,112 suggests that resilient members be used between inclined surfaces formed as part of a bearing adapter and a pedestal jaw of the side frame. The resilient members promote movemwent between the axle ends and the side frame and thus improve frictional snubbing therebetween.

Further connecting means is suggested in U.S. Pat. No. 3,699,897. Resilient pads connect the wheelset axle ends to the side frames so as to accommodate while cushioning axial movements of the wheelsets.

Lastly, copending application Ser. No. 061,027, now abandoned suggests that a chevron-shaped elastomeric device interface between each wheelset axle end and respective side frame pedestal jaw. These devices accommodate a certain amount of lateral movement of each wheelset while inhibiting longitudinal or vertical movement of such.

SUMMARY OF THE INVENTION

A railroad car truck comprises a pair of spaced side frames. At ends of each side frame is a downwardly facing pedestal jaw. The truck further includeds a pair of wheelsets with each wheelset having its axle ends journaled in bearings positioned respectively within the side frame pedestal jaws. Operatively interfacing between each side frame pedestal jaw and respective bearing is a bearing adapter and an elastomeric device.

The elastomeric device comprises an elastic material pad sandwiched between an upper and lower plate. To secure the location of the device, the plates may be formed with locating impressions which mate with complementarily formed impressions in the adapter and pedestal jaw. A shear strength of the elastic material is so chosen to provide an elastic restraint to horizontal movements between the wheelsets and side frame. This elastic restraint cushions these movements as well as restricts the movements to set limits. Thus the wheelsets and side frames remain in a substantially squared relationship at all times.

The railroad car truck with this invention has several advantages over known trucks.

A first advantage is that maintaining the wheelsets and side frames in a squared relationship by providing a high degree of stiffness in the side frame-wheelset connection increases critical speed of the truck. Thus, the truck has improved dynamic characteristics at higher speed travel.

A second advantage is that this side frame-wheelset connection is relatively simple and thus inexpensive and easily maintainable.

DESCRIPTION OF THE DRAWINGS

FIG. 1 is a fragmentary side elevational view in partial section of a railroad car truck having a side frame-wheelset connection incorporating this invention.

FIG. 2 is a cross-section of the truck seen generally along the line 2—2 of FIG. 1.

DESCRIPTION OF THE PREFERRED EMBODIMENT

Figure 3:
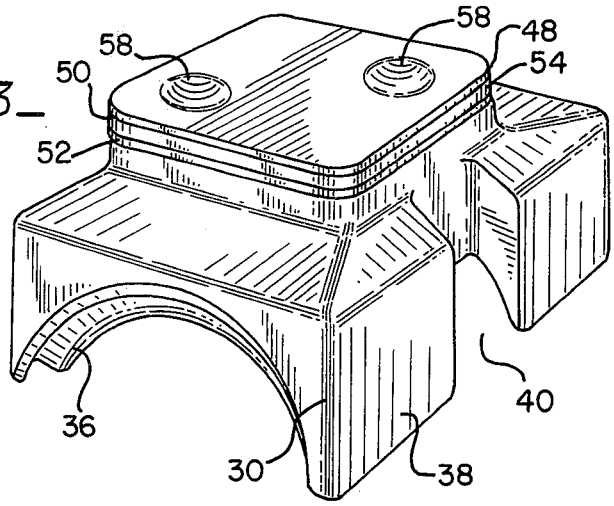
FIG. 3 is a perspective view of an adapter and elastomeric device usable in the side frame-wheelset connection of FIG. 1.
Figure 4:
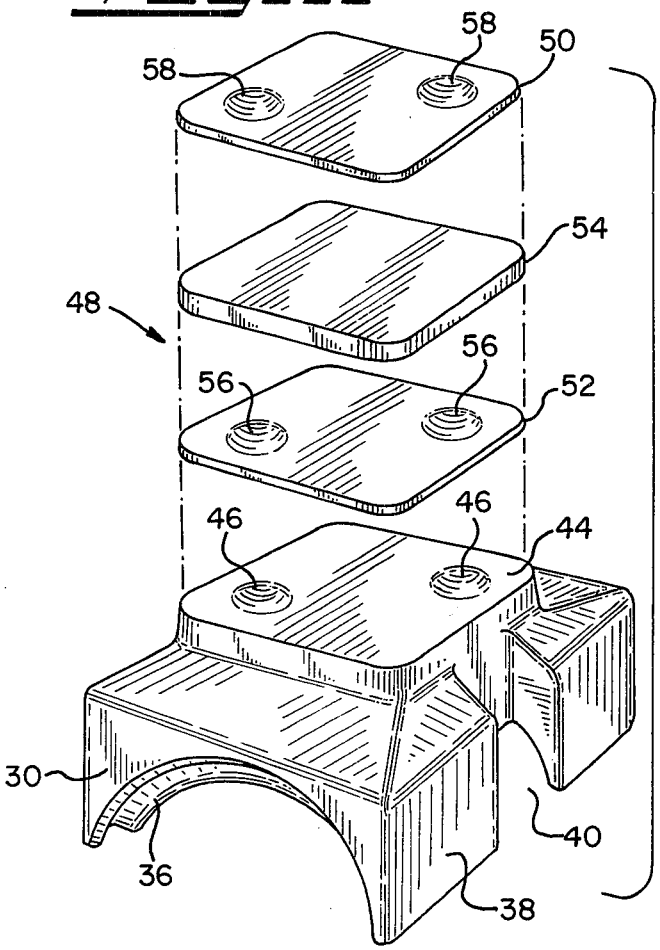
FIG. 4 is an explosion view of the adapter and elastomeric device of FIG. 3.

A rear portion of a railroad car truck is shown generally in FIG. 1 and designated 10. The truck 10 may be of a standard three-piece design wherein a pair of spaced side frames resiliently support ends of a transversely positioned bolster (not shown). Only an end portion 12 of one such side frame 14 is shown. As is understood, a typical railroad car includes two such trucks 10 which support ends of a railroad car body (not shown).

In the side frame end portion 12 is a downwardly facing pedestal jaw 16 defined by spaced end walls 18, 20. Again it should be appreciated that there are four such pedestal jaws in which axle ends of a front and rear wheelset are located. The rear wheelset 22 is shown in part with an axle end 24 located within the pedestal jaw 16.

The wheelset 22 is free to rotate and, as seen in FIG. 1, would rotate clockwise when the truck 10 is traveling in a forward direction as denoted by the arrow F. The rotational movement is enhanced by a set of roller bearings associated with the axle ends with a roller bearing 26 shown associated with the axle end 24.

A connection 28 operatively joining the bearing 26 to the side frame 14 includes an adapter 30 having a lower radiused surface 32 which fits over an upper portion 34 of the bearing 26. The adapter 30 further includes spaced downwardly depending semicircular side member 36 which interacts with ends of the bearing 26 to prevent lateral movement between such. The side members 36 are joined by end walls 38. In each end wall 38 is a vertical recess 40.

The adapter 30 fits within the pedestal jaw 16 with the adapter end walls 38 positioned loosely adjacent to the end walls 18, 20 of the pedestal jaw 16. On pedestal jaw end walls 18, 20 are inwardly projecting ribs 42 which fit loosely with the adapter recesses 40. A top surface 44 of the adapter 30 is substantially flat and may be formed having locating impressions being in this case a set of indentations 46. Each indentation 46 is longitudinally and laterally offset an equidistance from a center of the connection 28.

The connection 28 further includes an elastomeric device 48 comprising an upper and lower plate 50, 52 spaced apart and joined by an elastic pad 54. The material for the pad 54 has been so chosen to have a stiffness in shear of proximately 40,000 psi. The lower plate 52 is formed with a set of downwardly extending bosses 56 positioned to fit complementarily into the indentations 46 in the adapter top surface 44. The upper plate 50 is similarly formed with a set of indentations 58.

Lastly, a roof 60 of the side frame pedestal jaw 16 is likewise provided with a set of bosses 62 which fit into the elastomeric pad upper plate indentation 58. These bosses 62 may be integrally formed as part of the side frame pedestal jaw roof 60, for example.

During operation of the railroad car wherein the truck 10 travels over sections of track, there is little to no relative vertical movement within the connection 28 since the elastic pad 54 is too thin to provide vertical cushioning. Vertical cushioning, however, is provided in the side frame-bolster connection in a known manner.

Horizontal movement between the wheelset 22 and side frames 14 does occur and is cushioned by placing the elastic pad 54 in shear. The pad 54 is sufficiently stiff to limit these horizontal movements so that the connection 28 maintains the wheelset 22 and side frame 14 in a substantially squared relationship at all times. This squared relationship in turn inhibits truck lozenging and promotes dynamic stability of the truck 10 by raising the critical speed of the truck 10.

While various modifications may be suggested by those versed in the art, it should be understood that I wish to embody within the scope of the patent warranted hereon, all such modifications as reasonably and properly come within the scope of my contribution to the art.

What is claimed is:

1. A connection arrangement for joining an axle end to a side frame pedestal jaw of a railroad car truck wherein said axle end is journaled in a bearing positioned within said pedestal jaw, said arrangement comprising, an adapter means carried on an upper portion of said bearing, said means including spaced downward depending semicircular side members to interact with ends of said bearing and prevent relative movement thereof, end walls each having a vertical recess formed therein joining said side member, and a substantially flat top surface containing indentations, an elastomeric device comprising an elastic pad affixed between spaced lower and upper plates to cushion relative horizontal movements of said plates and maintain said movements within set limits, said upper plate and said lower plate having indentations on the upper surface thereof and having downwardly extending bases on lower surfaces thereof said lower plate downwardly extending bosses fitting with said adapter means top surface indentations upon said device being disposed on said adapter top surface, and said side frame pedestal jaw defined by a substantially flat roof joined by end walls spaced to receive said adapter therebetween with a loose fit, each said pedestal jaw end wall carrying an outwardly projecting rib to fit within said adapter end wall recess with a loose fit, said pedestal jaw roof having downwardly projecting bosses fitting with complementary indentations of said elastomeric device upper plate upon said axle end, said adapter, and said elastomeric device being disposed in said pedestal jaw.

2. The connecting arrangement of claim 1, wherein the indentations and bosses of the upper and lower plates are in alignment.

* * * * *